US008668121B2

(12) United States Patent
Lamboux

(10) Patent No.: US 8,668,121 B2
(45) Date of Patent: Mar. 11, 2014

(54) FILLING DEVICE

(75) Inventor: Jean-Philippe Lamboux, Saint Didier des Bois (FR)

(73) Assignee: Techniplast, Louviers (FR)

( * ) Notice: Subject to any disclaimer, the term of this patent is extended or adjusted under 35 U.S.C. 154(b) by 318 days.

(21) Appl. No.: 12/968,629

(22) Filed: Dec. 15, 2010

(65) Prior Publication Data

US 2011/0139829 A1 Jun. 16, 2011

(30) Foreign Application Priority Data

Dec. 16, 2009 (FR) ..... 09 59035

(51) Int. Cl.

| | |
|---|---|
| ***B67D 3/00*** | (2006.01) |
| ***B22D 37/00*** | (2006.01) |
| ***B22D 41/00*** | (2006.01) |
| ***B67D 7/06*** | (2010.01) |
| ***C21B 7/12*** | (2006.01) |

(52) U.S. Cl.
USPC ..... 222/484; 222/509; 222/518

(58) Field of Classification Search
USPC ..... 222/484, 505, 509, 481, 482, 501, 508
See application file for complete search history.

(56) References Cited

U.S. PATENT DOCUMENTS

| | | | | |
|---|---|---|---|---|
| 1,182,452 | A * | 5/1916 | Bucklin | 141/296 |
| RE22,837 | E | 1/1947 | Sanchis | |
| 2,469,746 | A * | 5/1949 | Sanchis | 141/296 |
| 4,598,743 | A * | 7/1986 | Milling | 141/296 |
| 4,722,463 | A * | 2/1988 | Anderson | 222/185.1 |
| 5,107,909 | A * | 4/1992 | Donovan | 141/296 |
| 5,323,832 | A * | 6/1994 | Burrows | 222/1 |
| 6,227,419 | B1 * | 5/2001 | Raboin | 222/484 |
| 6,401,752 | B1 * | 6/2002 | Blackbourn et al. | 137/588 |
| 2002/0079001 | A1 | 6/2002 | Blackbourn et al. | |

FOREIGN PATENT DOCUMENTS

| | | | |
|---|---|---|---|
| DE | 202004000296 | U1 | 3/2004 |
| EP | 112938 | A2 * | 7/1984 |
| GB | 2 220 408 | A | 1/1990 |
| WO | 2007/105936 | A1 | 9/2007 |

OTHER PUBLICATIONS

French Search Report, Dated Aug. 4, 2008, in French Application No. 0959035.

* cited by examiner

*Primary Examiner* — Paul R Durand
*Assistant Examiner* — Matthew Lembo
(74) *Attorney, Agent, or Firm* — Young & Thompson

(57) ABSTRACT

Filling device (1, 101) including a reservoir (3, 103) intended to contain liquid, a valve (4, 104) connected to the reservoir and a spout (20, 120), in which the valve has a shutter (10, 110) and a shutter seat (11), a flow circuit having a liquid inlet adjacent to the shutter seat and a liquid outlet adjacent to the spout, the liquid outlet being located lower than the liquid inlet, and an air intake circuit separate from the flow circuit, in which a pushrod (22, 122) has an upper end adjacent to the shutter. The pushrod includes a first duct (27) and a second duct (28), the air inlet circuit including the first duct, the flow circuit including the second duct.

14 Claims, 3 Drawing Sheets

FILLING DEVICE

TECHNICAL FIELD OF THE INVENTION

The present invention relates to a container filling device. It may be, for example, a device for refilling a perfume bottle.

PRIOR ART

Perfumes are generally contained in glass bottles which have an attractive design. When a perfume bottle is empty, it is discarded and a new, full bottle is bought. This represents a significant waste, since the empty bottle is still perfectly functional.

To avoid this waste, it is known to refill an empty bottle with perfume by using a filling device. This type of device is sometimes called a "fountain" or "source".

A known filling device comprises a perfume reservoir, a valve and a spout. By placing an empty bottle against the spout, the spout can be moved, thereby actuating the valve and allowing perfume to exit the reservoir by gravity. The reservoir of the known filling device consists of a flexible pouch located in a rigid housing. Thus, when perfume exits the reservoir, the pouch deforms and it is not necessary to provide an air intake.

A drawback with this filling device is that the material selected for the flexible pouch has to comply with the constraints of compatibility with the perfume. In addition, it has to be flexible enough for virtually all the perfume contained therein to flow by gravity. It is difficult to select a material that complies well with these conditions.

Document US RE 22 837 describes a filling device comprising a reservoir, a valve connected to the reservoir and a spout. A flow circuit has a liquid inlet adjacent to the valve and a liquid outlet adjacent to the spout. The liquid outlet is located lower than the liquid inlet. The air outlet in the reservoir is close to the valve and the air inlet is located between the liquid inlet and the liquid outlet. A drawback with this filling device is that it makes no distinction between the air inlet circuit and the flow circuit.

SUMMARY OF THE INVENTION

A problem that the present invention proposes to solve is that of providing a filling device that does not have at least some of the abovementioned drawbacks of the prior art. In particular, one aim of the invention is to be able to store the perfume in a rigid reservoir.

The solution provided by the invention is a filling device comprising a reservoir intended to contain liquid, a valve connected to the reservoir and a spout, in which the valve has a shutter and a shutter seat, a flow circuit having a liquid inlet adjacent to the shutter seat and a liquid outlet adjacent to the spout, said liquid outlet being located lower than said liquid inlet, and an air intake circuit separate from said flow circuit and having an air outlet adjacent to said shutter seat and an air inlet located at a height between said liquid inlet and said liquid outlet, in which a pushrod has an upper end adjacent to said shutter, said pushrod being able to move between a first position, in which it allows the shutter to engage with the shutter seat, and a second position, in which it moves said shutter away from the shutter seat, characterized in that said pushrod comprises a first duct and a second duct, said air inlet circuit including said first duct, said flow circuit including said second duct.

Such a pushrod makes it possible to separate the two circuits.

According to one embodiment, said flow circuit includes a flow tube which connects said second duct to the spout.

Advantageously, a sleeve surrounds said pushrod, said air inlet circuit including a free space located next to the pushrod in the sleeve.

According to one embodiment, said sleeve has at least one orifice opening into said space, said air inlet circuit including said orifice.

Preferably, said spout is fixed to said sleeve, said sleeve being connected to said pushrod.

According to one embodiment, the reservoir is made of rigid material.

BRIEF DESCRIPTION OF THE FIGURES

The invention will be understood more clearly, and further aims, details, features and advantages thereof will become more clearly apparent from the following description of a plurality of particular embodiments of the invention, which are given solely by way of illustration and in a non-limiting manner, with reference to the appended drawings, in which.

DETAILED DESCRIPTION OF EMBODIMENTS OF THE INVENTION

Figure 1:
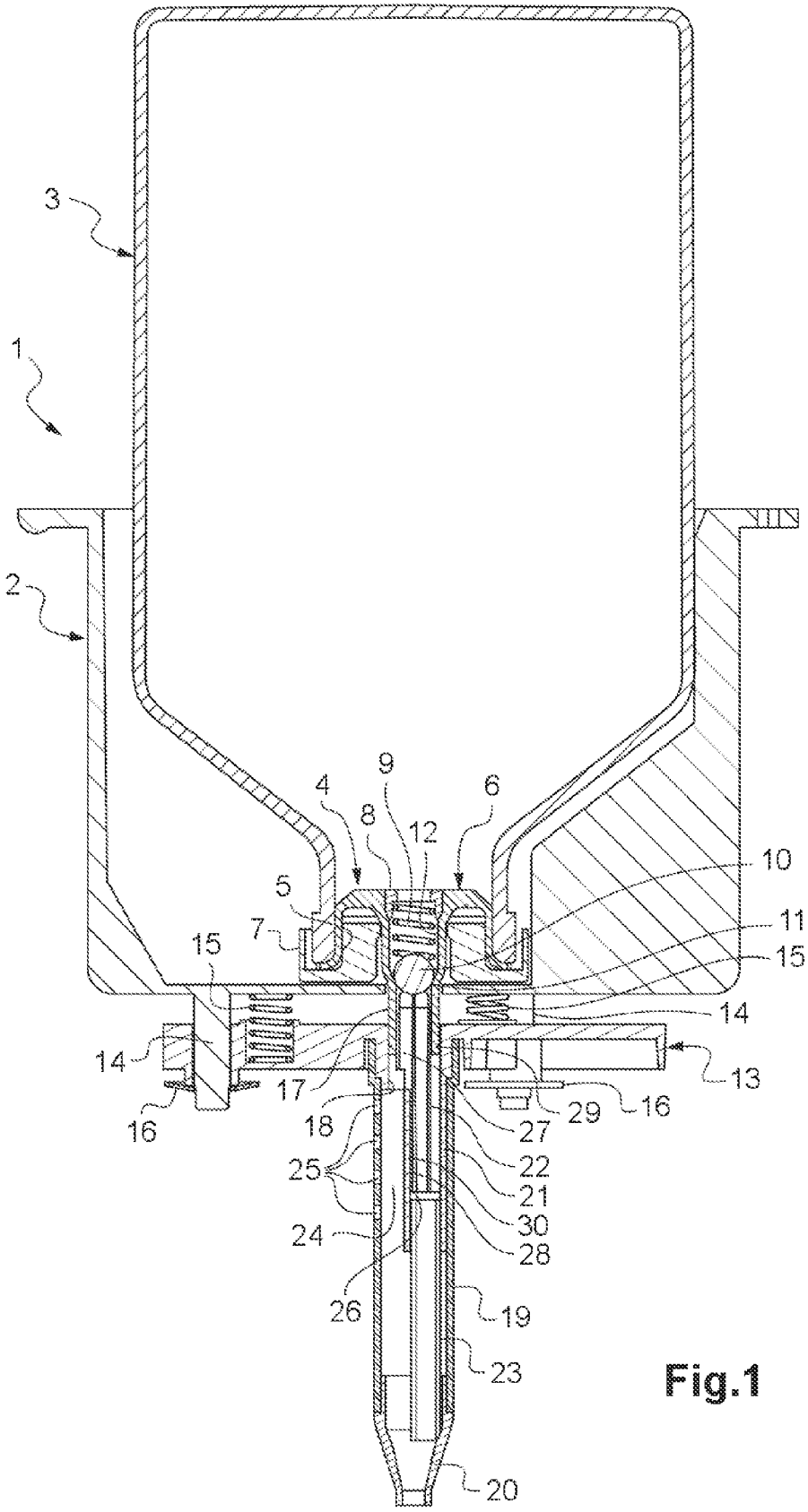
FIG. 1 is a section view of a filling device according to one embodiment of the invention.
Figure 2:
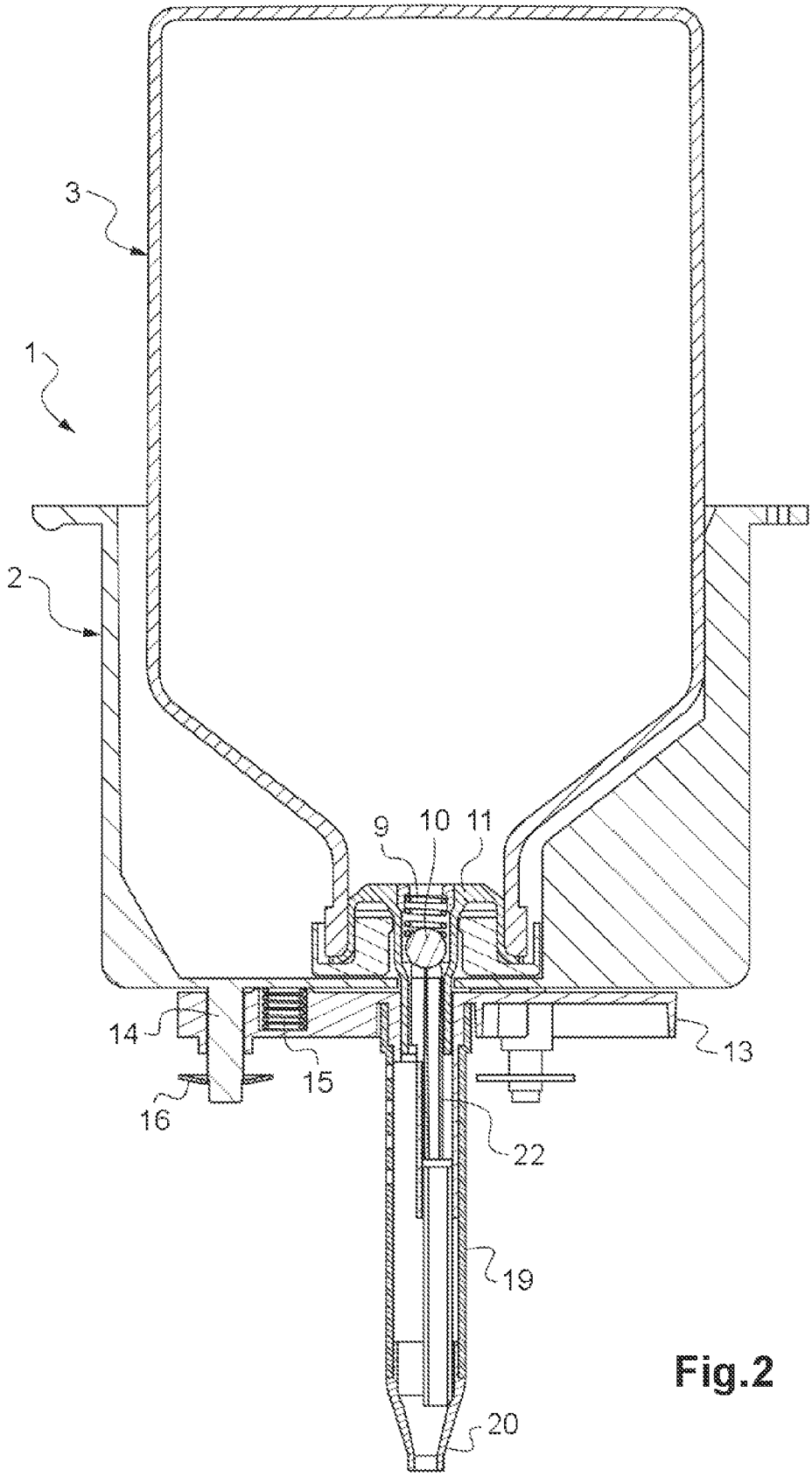
FIG. 2 is a section view of the filling device from FIG. 1 during filling.

FIGS. 1 and 2 show a filling device 1 according to a first embodiment of the invention. The filling device 1 is intended for refilling an empty perfume bottle. Alternatively, it could serve for other applications.

The filling device 1 comprises an upwardly open receptacle 2, into which a reservoir 3 is introduced. The reservoir 3 has an opening 5 and is arranged upside-down, that is to say with the opening 5 in the bottom of the receptacle 2. The reservoir 3 is rigid, for example is made of glass.

A valve 4 closes off the opening 5. More precisely, the valve 4 comprises a part 6 housed in the opening 5 and connected in a sealed manner by a seal 7. The part 6 delimits a passage 12 in which a shutter seat 11 is located. The valve 4 also comprises a ball 10 able to engage with the shutter seat 11. A spring 9 pressing on a base 8 clip-fastened into the part 6 urges the ball 10 toward the shutter seat 11. The part 6 has a skirt 17, which passes through the wall of the bottom of the receptacle 2 and extends the passage 12 under the receptacle 2.

The filling device 1 also comprises a mechanism for controlling the opening of the valve 4 and dispensing the liquid contained in the reservoir 3. This mechanism is described in detail hereinbelow.

A control plate 13 is located under the receptacle 2. The control plate 13 is guided in translation with respect to the receptacle 2 by studs 14 protruding from the lower face of the receptacle 2. Springs 15 urge the control plate away from the receptacle 2, in abutment with washers 16 fixed to the studs 14.

As can be seen in FIGS. 1 and 2, the skirt 17 of the part 6 opens into a passage 18 through the control plate 13.

A sleeve 19 is fixed to the control plate 13, on the opposite side from the receptacle 2, and extends the passage 18. A spout 20 is fixed to the end of the sleeve 19.

In the sleeve 19, the filling device 1 comprises an internal skirt 21, a pushrod 22 and a flow tube 23.

The internal skirt 21 is produced in one piece with the control plate 13. It has a generally cylindrical form with a cross section smaller than the sleeve 19 and than the passage 18. Thus, in the sleeve 19 there is located a free space 24 next to the internal skirt 21. As FIGS. 1 and 2 show, the free space 24 communicates on the one hand with the passage 18 and on the other hand with the outside of the sleeve 19, by virtue of orifices 25 made in the wall of the sleeve 19. In a variant that is not shown, the sleeve has no orifice and the free space communicates with the outside by virtue of an air-permeable sleeve-control plate link.

The pushrod 22 has a first end adjacent to the ball 10 and an opposite end pressing against a shoulder 26 of the internal skirt 21. In its upper part, the pushrod has a wall 29 in the form of an axisymmetrical cylinder, having a central wall 30. In its lower part, the central wall 30 is extended and the wall 29 has only a semi-circular cross section. Thus, the pushrod 22 delimits a short duct 27 and a long duct 28.

The duct 27 opens out at one end next to the ball 10 and at the other end into the passage 18, close to the free space 24. Thus, the orifices 25, the free space 24, the passage 18 and the duct 27 form an air inlet circuit which connects the outside of the sleeve 19 to the valve 4.

The duct 28 opens out at one end next to the ball 10 and at the other end into the internal skirt 21, by the shoulder 26. The flow tube 23 is fitted into the internal skirt 21 and extends as far as the spout 20. Thus, the duct 28 and the flow tube 23 form a flow circuit connecting the valve 4 to the spout 20.

It is noted that the air inlet duct and the flow circuit are separated from one another and that the inlet of the air inlet circuit is located at a height between the inlet and the outlet of the flow circuit.

Since an air intake is provided, the reservoir can be made of rigid material. In addition, since the two circuits open out at the valve, an N valve is necessary. The two circuits allow a flow of liquid and a flow of air to circulate without disturbing one another.

The filling device 1 operates as follows.

FIG. 1 shows the filling device 1 at rest. In this rest state, the spring 8 presses the ball 10 against the shutter seat 11 and the springs 15 keep the control plate 13 away from the bottom of the receptacle 2. The upper end of the pushrod 22 is adjacent to the ball 10 without in the process preventing the ball 10 engaging with the shutter seat 11.

Thus, in this rest state, the valve 4 is closed. The liquid contained in the reservoir 3 cannot flow through the opening 5 and air cannot enter the reservoir 3.

FIG. 2 shows the filling device 1 in a filling state. In order for the filling device 1 to pass into this state, all that is necessary is to place the opening of a container to be filled, for example an empty perfume bottle, against the spout 20 and to move it upward. Since the spout 20 is connected to the sleeve 19, which is itself connected to the control plate 13, which is itself connected to the pushrod 22 via the shoulder 26 of the internal skirt 21, the effect of this is that the pushrod 22 is moved upward and thus moves the ball 10 away from the shutter seat 11. The valve 4 is thus opened.

As described above, the filling device 1 comprises a flow circuit that has an inlet adjacent to the shutter seat 11 and an outlet at the spout 20. The filling device 1 also comprises an air intake circuit which is separate from the flow circuit and has an outlet adjacent to the shutter seat 11 and an inlet located at a height between the inlet and the outlet of the filling circuit.

Thus, since the valve 4 is open in the filling state, the liquid present in the reservoir 3 can flow out of the reservoir 3 and air can enter the latter to replace the liquid that has flowed out.

It was noted that, on account of the features of the air intake and flow circuits, the liquid was able to flow through the flow circuit while the air passes through the air intake circuit, without these two flows disturbing one another. At the shutter seat, these two flows cross one another without blocking one another.

Thus, a single valve is enough for the flow of liquid and the intake of air at the same time. It is not necessary to provide a second valve or a double-chamber mechanism or any other additional system for the intake of air.

Optionally, liquid can also flow through the duct 27 and the free space 24 before reaching the spout 20.

Figure 3:
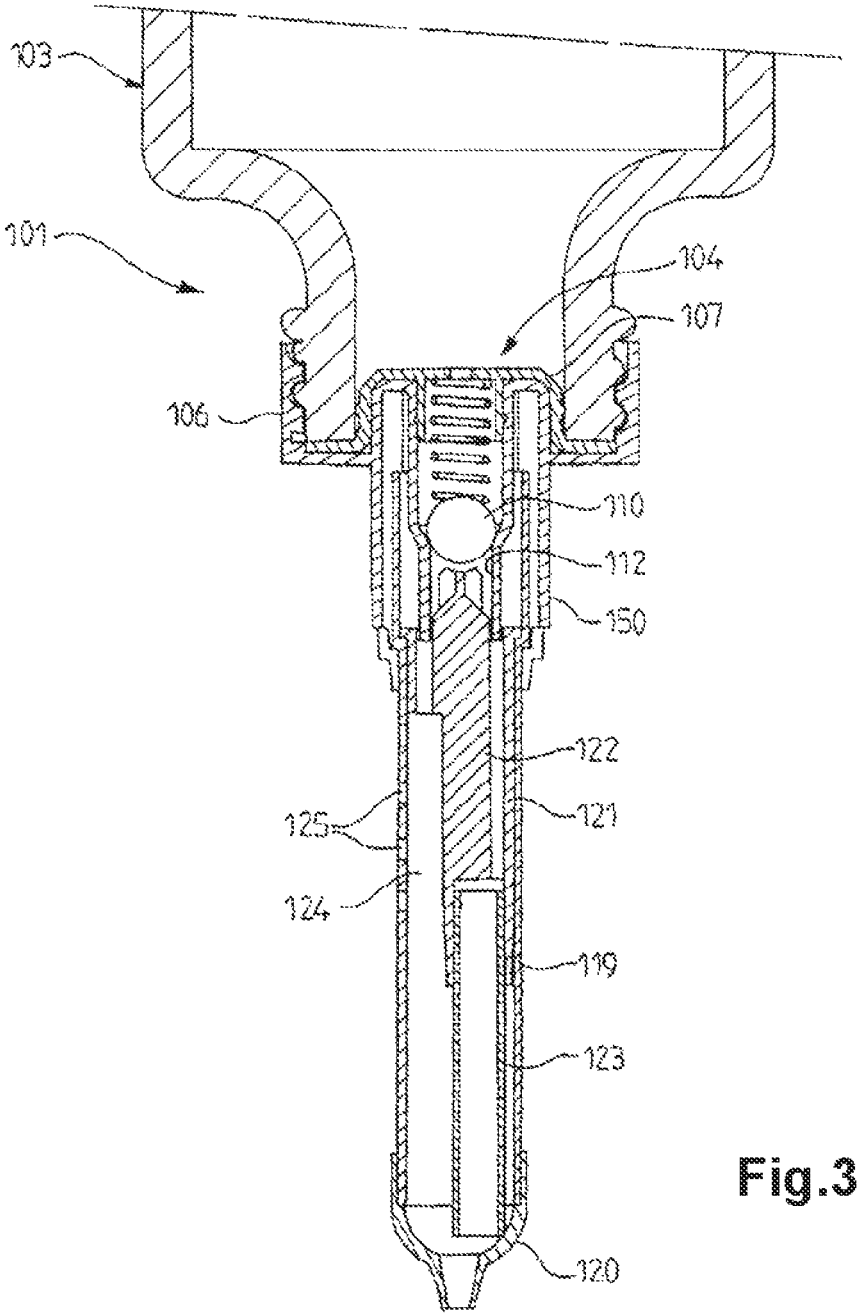
FIG. 3 is a section view of a filling device according to another embodiment of the invention.

FIG. 3 shows a filling device 101 according to a second embodiment of the invention. Elements identical or similar to elements of the first embodiment are designated by corresponding reference numerals, increased by 100.

As can be seen by comparing FIGS. 1 and 3, the filling device 101 differs mainly by the absence of a receptacle and of a control plate. The end of the reservoir 103 has a screw thread and the valve 104 is screwed there by the part 106. Sealing is ensured by the seal 107. The part 106 has an external skirt 150, which surrounds the passage 112 and in which the upper end of the sleeve 119 can slide.

The filling device 101 operates in a similar manner to the filling device 1 and will not be described in detail. In brief, the upward movement of the spout 120 causes the movement of the sleeve 119, of the flow tube 123 and of the pushrod 122. Thus, the pushrod 122 moves the ball 110 and opens the valve 104.

When the valve 104 is open, liquid can flow through the flow circuit and air can enter through the air intake circuit, which comprises in particular the orifices 125 and the free space 124.

Although the invention has been described in connection with a plurality of particular embodiments, it is clear that it is in no way limited thereto and comprises all the technical equivalents of the means described and also combinations thereof, as long as the latter lie within the scope of the invention.

The invention claimed is:

1. A filling device, comprising:

a reservoir intended to contain liquid;

a valve connected to the reservoir and a spout, in which the valve has a shutter and a shutter seat;

a flow circuit having a liquid inlet adjacent to the shutter seat and a liquid outlet adjacent to the spout, said liquid outlet being located lower than said liquid inlet; and an air intake circuit separate from said flow circuit and having an air outlet adjacent to said shutter seat and an air inlet located at a height between said liquid inlet and said liquid outlet, in which a pushrod has an upper end adjacent to said shutter, said pushrod being able to move between a first position, in which the pushrod allows the shutter to engage with the shutter seat, and a second position, in which the pushrod moves said shutter away from the shutter seat, and a sleeve surrounds said pushrod, said air inlet circuit including a free space located next to the pushrod in the sleeve, wherein said pushrod is distinct from said shutter and comprises a first duct and a second duct, said air inlet circuit including said first duct, said flow circuit including said second duct, said flow circuit including a flow tube which connects said second duct to the spout, and said first and second ducts open out adjacent to the shutter in such a manner that, in the first position of said pushrod, the first and second ducts do not enable air to enter into the reservoir and liquid to flow out from the reservoir and, in the second position, first and second ducts simultaneously enable air to enter into the reservoir and liquid to flow out from the reservoir directly from said first position.

2. The filling device according to claim 1, wherein said sleeve has at least one orifice opening into said space, said air inlet circuit including said orifice.

3. The filling device according to claim 2, wherein said spout is fixed to said sleeve, said sleeve being connected to said pushrod.

4. The filling device according to claim 1, wherein said spout is fixed to said sleeve, said sleeve being connected to said pushrod.

5. The filling device according to claim 1, wherein the reservoir is made of rigid material.

6. The filling device according to claim 1, wherein said spout is fixed to said sleeve, said sleeve being connected to said pushrod.

7. The filling device according to claim 1, wherein the first duct is shorter than the second duct.

8. The filling device according to claim 1, wherein the valve comprises a part housed in an opening and is connected in a sealed manner by a seal.

9. The filling device according to claim 8, wherein the part delimits a passage in which a shutter seat is located.

10. The filling device according to claim 9, wherein the valve further comprises:

a ball able to engage with the shutter seat; and a spring pressing on a base clip-fastened into the part so as to urge the ball toward the shutter seat.

11. The filling device according to claim 10, wherein the part has a skirt which passes through a wall of a bottom of a receptacle and extends a passage under the receptacle.

12. A filling device, comprising:

a reservoir intended to contain liquid;

a valve connected to the reservoir and a spout, in which the valve has a shutter and a shutter seat;

a flow circuit having a liquid inlet adjacent to the shutter seat and a liquid outlet adjacent to the spout, said liquid outlet being located lower than said liquid inlet; and an air intake circuit separate from said flow circuit and having an air outlet adjacent to said shutter seat and an air inlet located at a height between said liquid inlet and said liquid outlet, in which a pushrod has an upper end adjacent to said shutter, said pushrod being able to move between a first position, in which the pushrod allows the shutter to engage with the shutter seat, and a second position, in which the pushrod moves said shutter away from the shutter seat, wherein said pushrod is distinct from said shutter and comprises a first duct and a second duct, said air inlet circuit including said first duct, said flow circuit including said second duct, and said first and second ducts open out adjacent to the shutter in such a manner that, in the first position of said pushrod, the first and second ducts do not enable air to enter into the reservoir and liquid to flow out from the reservoir and, in the second position, first and second ducts simultaneously enable air to enter into the reservoir and liquid to flow out from the reservoir directly from said first position, the valve comprises a part housed in an opening and is connected in a sealed manner by a seal, the part delimits a passage in which a shutter seat is located, the valve further comprises a ball able to engage with the shutter seat, and a spring pressing on a base clip-fastened into the part so as to urge the ball toward the shutter seat, the part has a skirt which passes through a wall of a bottom of a receptacle and extends a passage under the receptacle, and wherein a control plate is located under the receptacle, and the control plate is guided in translation with respect to the receptacle by studs protruding from a lower face of the receptacle.

13. The filling device according to claim 12, wherein springs urge the control plate away from the receptacle, in abutment with washers fixed to the studs.

14. A filling device, comprising:

a reservoir intended to contain liquid;

a valve connected to the reservoir and a spout, in which the valve has a shutter and a shutter seat;

a flow circuit having a liquid inlet adjacent to the shutter seat and a liquid outlet adjacent to the spout, said liquid outlet being located lower than said liquid inlet; and an air intake circuit separate from said flow circuit and having an air outlet adjacent to said shutter seat and an air inlet located at a height between said liquid inlet and said liquid outlet, in which a pushrod has an upper end adjacent to said shutter, said pushrod being able to move between a first position, in which the pushrod allows the shutter to engage with the shutter seat, and a second position, in which the pushrod moves said shutter away from the shutter seat, and a sleeve surrounds said pushrod, said air inlet circuit including a free space located next to the pushrod in the sleeve, wherein said pushrod is distinct from said shutter and comprises a first duct and a second duct, the first duct being shorter than the second duct, said air inlet circuit including said first duct, said flow circuit including said second duct, said flow circuit including a flow tube which connects said second duct to the spout, and said first and second ducts open out adjacent to the shutter in such a manner that, in the first position of said pushrod, the first and second ducts do not enable air to enter into the reservoir and liquid to flow out from the reservoir and, in the second position, first and second ducts simultaneously enable air to enter into the reservoir and liquid to flow out from the reservoir directly from said first position.

* * * * *